US011393419B2

(12) United States Patent
Shi et al.

(10) Patent No.: US 11,393,419 B2
(45) Date of Patent: Jul. 19, 2022

(54) METHOD AND COMPUTER-READABLE MEDIUM FOR DISPLAYING IMAGE, AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Tiankuo Shi, Beijing (CN); Lingyun Shi, Beijing (CN); Xiaomang Zhang, Beijing (CN); Zhihua Ji, Beijing (CN); Yafei Li, Beijing (CN); Xin Duan, Beijing (CN); Xiurong Wang, Beijing (CN); Wei Sun, Beijing (CN); Hao Zhang, Beijing (CN); Ming Chen, Beijing (CN); Yuxin Bi, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 3 days.

(21) Appl. No.: 16/769,879

(22) PCT Filed: Dec. 12, 2019

(86) PCT No.: PCT/CN2019/124821
§ 371 (c)(1),
(2) Date: Jun. 4, 2020

(87) PCT Pub. No.: WO2020/140719
PCT Pub. Date: Jul. 9, 2020

(65) Prior Publication Data

US 2021/0225303 A1 Jul. 22, 2021

(30) Foreign Application Priority Data

Jan. 4, 2019 (CN) ..... 201910008127.0

(51) Int. Cl.
*G09G 3/36* (2006.01)
*G09G 3/34* (2006.01)
*G09G 3/00* (2006.01)

(52) U.S. Cl.
CPC ..... *G09G 3/3607* (2013.01); *G09G 3/3406* (2013.01); *G09G 2320/0626* (2013.01);
(Continued)

(58) Field of Classification Search
None
See application file for complete search history.

(56) References Cited

U.S. PATENT DOCUMENTS 9,953,602 B2 4/2018 Choi et al.
10,657,903 B2 5/2020 Liu et al.
(Continued)

FOREIGN PATENT DOCUMENTS

CN 102111613 A 6/2011
CN 103491335 A 1/2014
(Continued)

OTHER PUBLICATIONS

International Search Report dated Mar. 13, 2020, issued in counterpart application No. PCT/CN2019/124821 (12 pages).
(Continued)

*Primary Examiner* — Benjamin C Lee
*Assistant Examiner* — Emily J Frank
(74) *Attorney, Agent, or Firm* — WHDA, LLP

(57) ABSTRACT

The display technologies relate to a method and computer-readable medium for displaying image and to a display device configured to perform the method for displaying
(Continued)

image. The image display method includes acquiring an image for display in an $n^{th}$ frame on a display screen; detecting a first sub-image and a second sub-image within the image, a resolution of the first sub-image being higher than a resolution of the second sub-image; comparing the first sub-image in the $n^{th}$ frame with a corresponding sub-image in an $(n-1)^{th}$ frame; and refreshing a localized area of the display screen positionally corresponding to the first sub-image to display an interpolated sub-image in the localized area.

18 Claims, 12 Drawing Sheets

(52) U.S. Cl.
CPC . *G09G 2340/0407* (2013.01); *G09G 2354/00* (2013.01); *G09G 2360/16* (2013.01)

(56) References Cited

U.S. PATENT DOCUMENTS

| | | | | |
|---|---|---|---|---|
| 2002/0141655 | A1* | 10/2002 | Niemi | G06F 3/14 382/276 |
| 2014/0347267 | A1* | 11/2014 | Nishi | G06F 1/1643 345/156 |
| 2016/0111055 | A1 | 4/2016 | Na et al. | |
| 2016/0267884 | A1* | 9/2016 | Binstock | G09G 5/373 |
| 2017/0236252 | A1 | 8/2017 | Nguyen et al. | |
| 2018/0033399 | A1* | 2/2018 | Kawashima | G09G 3/3648 |
| 2019/0235817 | A1 | 8/2019 | Dai et al. | |
| 2019/0361658 | A1 | 11/2019 | Shi et al. | |
| 2020/0058152 | A1* | 2/2020 | Zhang | G02B 27/0093 |
| 2020/0218340 | A1 | 7/2020 | Shi et al. | |
| 2020/0319463 | A1* | 10/2020 | Nakamura | G02B 27/0179 |
| 2021/0049981 | A1* | 2/2021 | Seiler | G06T 15/06 |
| 2021/0398507 | A1* | 12/2021 | Hicks | G09G 5/227 |

FOREIGN PATENT DOCUMENTS

| | | | |
|---|---|---|---|
| CN | 105139792 | A | 12/2015 |
| CN | 106531073 | A | 3/2017 |
| CN | 106652972 | A | 5/2017 |
| CN | 106782268 | A | 5/2017 |
| CN | 106847158 | A | 6/2017 |
| CN | 107333119 | A | 11/2017 |
| CN | 108597435 | A | 9/2018 |
| CN | 109036246 | A | 12/2018 |
| CN | 109637406 | A | 4/2019 |

OTHER PUBLICATIONS

Office Action dated Mar. 18, 2020, issued in counterpart CN application No. 201910008127.0, with English translation. (33 pages).

* cited by examiner

METHOD AND COMPUTER-READABLE MEDIUM FOR DISPLAYING IMAGE, AND DISPLAY DEVICE

CROSS-REFERENCE TO RELATED APPLICATIONS

This application claims benefit of the filing date of Chinese Patent Application No. 201910008127.0 filed on Jan. 4, 2019, the disclosure of which is hereby incorporated in its entirety by reference.

TECHNICAL FIELD

The present disclosure generally relates to display technologies, and in particular, to a method and computer-readable medium for displaying image and to a display device configured to perform the method for displaying image.

BACKGROUND

With the development of technology, virtual reality (VR) display technology is quickly becoming a common tool in people's daily lives. As the technology grows and its use becomes more widespread, the demand for high-performance VR display technology and VR system also increases. A key to creating a highly immersive VR system is excellent display. However, the refresh rate of existing VR head-mounted display devices is 60 Hz. When an image is refreshed, this creates a perceptible lag that diminishes the immersiveness of the user experience.

BRIEF SUMMARY

The present disclosure provides an image display method. The image display method may comprise acquiring an image for display in an $n^{th}$ frame on a display screen; detecting a first sub-image and a second sub-image within the image, a resolution of the first sub-image being higher than a resolution of the second sub-image; comparing the first sub-image in the $n^{th}$ frame with a corresponding sub-image in an $(n-1)^{th}$ frame; and refreshing a localized area of the display screen positionally corresponding to the first sub-image to display an interpolated sub-image in the localized area.

In some embodiments, when a difference between positions of the first sub-image in the $n^{th}$ frame and the corresponding sub-image in the $(n-1)^{th}$ frame is equal to or higher than a predetermined threshold value, the interpolated sub-image may be the sub-image in the $(n-1)^{th}$ frame. When a difference between positions of the first sub-image in the $n^{th}$ frame and the corresponding sub-image in the $(n-1)^{th}$ frame is below the predetermined threshold value, the interpolated sub-image may be an overlapped portion of the first sub-image in the $n^{th}$ frame and the corresponding sub-image in the $(n-1)^{th}$ frame.

In some embodiments, the image display method may further comprise, before acquiring the image for display in the $n^{th}$ frame, detecting a gaze area on the display screen centered on a gaze point of a user, and generating the image for display in the $n^{th}$ frame based on the detected gaze area on the display screen.

In some embodiments, the image display method may further comprise, after generating the image for display in the $n^{th}$ frame, storing first image data for the first sub-image, and setting brightness for a backlight based on second image data for the second sub-image.

In some embodiments, the image display method may further comprise determining whether to perform interpolation based on a difference between a position of the detected gaze area for the $n^{th}$ frame and a position of a gaze area detected for the $(n-1)^{th}$ frame.

In some embodiments, the image display method may further comprise, if interpolation is not to be performed, mapping first image data for the first sub-image and second image data for the second sub-image onto pixels on a display device. If interpolation is to be performed, the image display method may further comprise combining the first image data with image data for the corresponding sub-image in the $(n-1)^{th}$ frame to produce image data for the interpolated sub-image.

In some embodiments, the image display method may further comprise, if interpolation is to be performed, performing localized refreshing of the image data for the first sub-image in the localized area to display the interpolated sub-image, and displaying the second sub-image to have the same content as in the $(n-1)^{th}$ frame.

In some embodiments, the refreshing of the localized area may comprise selectively activating gate lines for driving the localized area.

In some embodiments, the interpolated sub-image may be dimensioned to be the same as the first sub-image.

In some embodiments, during the refreshing of the localized area, gate lines for driving areas outside of the localized area may not be activated.

In some embodiments, the image display method may further comprise, before displaying the interpolated sub-image, determining a backlight brightness value for the display screen to display the interpolated sub-image.

In some embodiments, the image display method may further comprise, after determining the backlight brightness value and before displaying the interpolated sub-image, mapping the interpolated sub-image to respective pixels of the display screen.

In some embodiments, the image display method may further comprise, after mapping the interpolated sub-image and before displaying the interpolated sub-image, determining a grayscale value for each of the mapped pixels in accordance with the determined backlight brightness value.

In some embodiments, the image display method may further comprise, before displaying the interpolated sub-image, determining display coordinates of the first sub-image and the second sub-image on the display screen based on respective pixel coordinates in the first and second sub-image.

The present disclosure also provides a non-transitory computer-readable medium storing a program that, when executed by a computer, performs an image display method. The image display method may be as described above.

The present disclosure also provides a display system. The display system may comprise a memory, and a processor coupled to the memory, the processor being configured to perform an image display method. The image display method may be as described above.

The present disclosure also provides a display device. The display device may comprise an image retriever configured to acquire an image for display in an $n^{th}$ frame on a display screen, and detect a first sub-image and a second sub-image within the image, a resolution of the first sub-image being higher than a resolution of the second sub-image; an interpolator configured to determine an interpolated sub-image by comparing the first sub-image in the $n^{th}$ frame with a corresponding sub-image in an $(n-1)^{th}$ frame; and a display configured to refresh a localized area of the display screen positionally corresponding to the first sub-image to display the interpolated sub-image in the localized area.

In some embodiments, wherein when a difference between positions of the first sub-image in the $n^{th}$ frame and the corresponding sub-image in the $(n-1)^{th}$ frame is equal to or higher than a predetermined threshold value, the interpolated sub-image may be the sub-image in the $(n-1)^{th}$ frame. In some embodiments, when a difference between positions of the first sub-image in the $n^{th}$ frame and the corresponding sub-image in the $(n-1)^{th}$ frame is below the predetermined threshold value, the interpolated sub-image may be an overlapped portion of the first sub-image in the $n^{th}$ frame and the corresponding sub-image in the $(n-1)^{th}$ frame.

In some embodiments, the display may be further configured to selectively activate gate lines for driving the localized area to display the interpolated sub-image in the localized area.

In some embodiments, the display may comprise a backlight calculator, a mapper, and a grayscale compensator.

In some embodiments, the backlight calculator may be configured to, before the interpolated sub-image is displayed, determine a backlight brightness value for the display screen to display the interpolated sub-image.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the present disclosure are apparent from the following detailed description taken in conjunction with the accompanying drawings in which:

Figure 1:
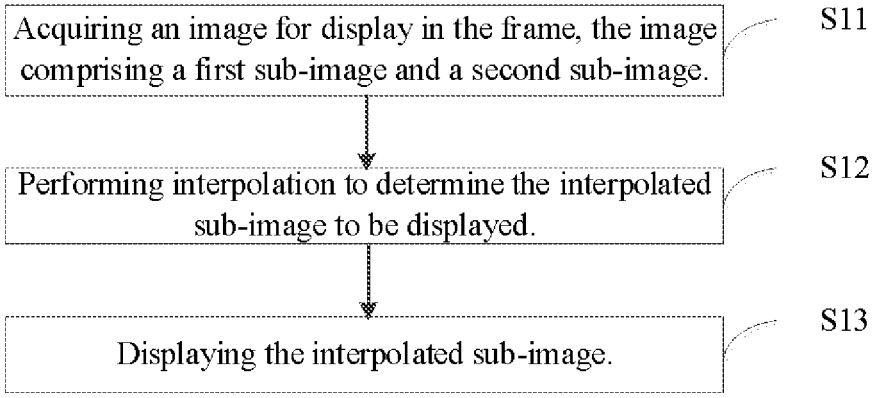
FIG. 1 shows a flow chart of an image display method according to an embodiment of the present disclosure.

The various features of the drawings are not to scale as the illustrations are for clarity in facilitating one skilled in the art in understanding the invention in conjunction with the detailed description.

DETAILED DESCRIPTION

Next, the embodiments of the present disclosure will be described clearly and concretely in conjunction with the accompanying drawings, which are described briefly above. The subject matter of the present disclosure is described with specificity to meet statutory requirements. However, the description itself is not intended to limit the scope of this disclosure. Rather, the inventors contemplate that the claimed subject matter might also be embodied in other ways, to include different steps or elements similar to the ones described in this document, in conjunction with other present or future technologies.

While the present technology has been described in connection with the embodiments of the various figures, it is to be understood that other similar embodiments may be used or modifications and additions may be made to the described embodiments for performing the same function of the present technology without deviating therefrom. Therefore, the present technology should not be limited to any single embodiment, but rather should be construed in breadth and scope in accordance with the appended claims. In addition, all other embodiments obtained by one of ordinary skill in the art based on embodiments described in this document are considered to be within the scope of this disclosure.

Virtual reality (VR) display technology is quickly becoming a common tool in people's daily lives. As the technology grows and its use becomes more widespread, the demand for high-performance VR display technology and VR system also increases. A key to creating a highly immersive VR system is excellent display. However, existing head-mounted VR display devices frequently suffer from slow refresh rate. The refresh rate of displays in existing head-mounted VR display devices is usually 60 Hz. When an image is refreshed, the slow refresh rate produces a judder effect that causes the display to appear jerky to the user, and that diminishes the immersiveness of the user experience.

However, directly increasing the refresh rate will also increase the data process load on the display device. Moreover, it is not always necessary to increase the refresh rate. In some situations, increasing the refresh rate is at best superfluous, and at worst, undesirable as the resulting display may cause fatigue or dizziness in the user.

The present disclosure addresses the above issues. The present disclosure provides localized adjustment of refresh rate to reduce jerkiness in the display without increasing the data process load on the display device. Through localized image processing such as localized interpolation, the present disclosure makes it possible to increase the overall refresh rate of a display device, smooth the displayed picture, and improve the user experience without the usual pitfalls in terms of data process burdens. It is understood that even though VR display devices are specifically described above, embodiments of the present disclosure may also apply to other display systems without departing from the scope and spirit of the present disclosure.

FIG. 1 shows a flow chart of an image processing method according to an embodiment of the present disclosure.

In step S11, an image for display in the frame is received. The image comprises a first sub-image and a second sub-image. The resolution of the first sub-image is equal to or higher than the resolution of the second sub-image.

The first sub-image represents a first portion of the image, and is identified based on the user's gaze point on the display screen. The position and coordinates of the first sub-image are therefore determined based on the user's gaze point on the display screen. The second sub-image represents a second portion of the image. The second portion may be the content outside of the first sub-image, or the second sub-image may be the full image itself.

In some embodiments, the image processing method comprises detecting the user's gaze point on the display screen. Based on the gaze point and the image data of the image for display, the image to be displayed in the frame is ascertained and acquired. The user's eye movements may be tracked to identify the coordinates of the user's gaze on the display screen, and then based on a preset measurement, detect and identify the gaze area and a plurality of non-gaze areas. The gaze area defines the first sub-image area. First image data are written to the first sub-image area. First image data are a portion of the image data that provides the content for the first sub-image. The geometry of the gaze area is not particularly limited. The gaze area may be a square, a circle, or any other shape known to a person of ordinary skill in the art. In some embodiments, the display screen is a square, and the gaze area is correspondingly configured to be a square. The size of the gaze area is smaller than the size of the display screen.

Second image data are written to the non-gaze areas. Second image data are a portion of the image data that provides the content for the second portion of the image, which may be the content outside of the first sub-image, or the second sub-image may be the full image itself.

The coordinates of the gaze area correspond to the coordinates of the first sub-image. Based on the coordinates, the corresponding image data is retrieved to acquire the first sub-image. Image data may be rendered by a suitably configured graphics processing unit (GPU) to detect the first sub-image and the second sub-image. The image for display in the frame is a composite of the first sub-image and the second sub-image. The configurations of the GPU are not particularly limited, and the GPU may be suitably configured in any manner known to a person of ordinary skill in the art depending on need and the specific implementation of the image processing method.

Figure 6:
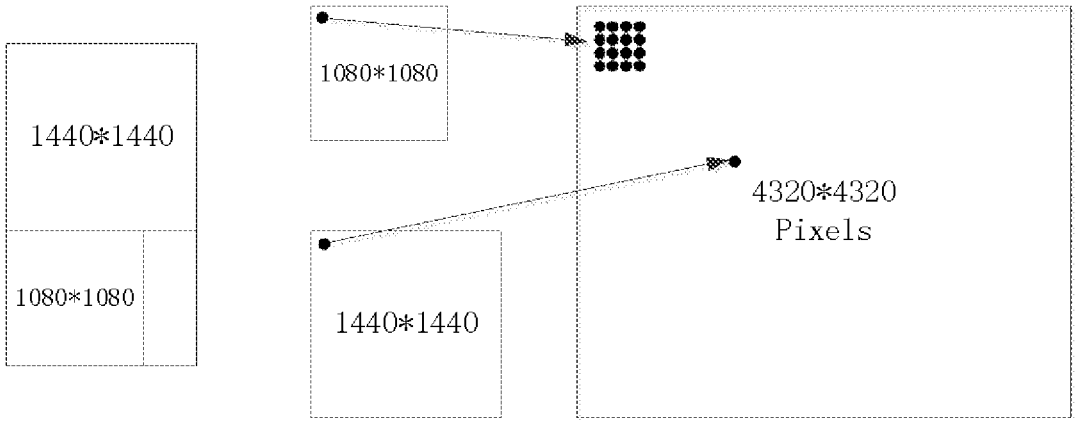
FIG. 6 shows a schematic diagram illustrating a process of determining display coordinates according to the present disclosure.

In some embodiments where a high-definition display is required, the resolution of the first sub-image is higher than the resolution of the second sub-image. As a non-limiting example, FIG. 6 shows a first sub-image having a resolution of 1440*1440, and a second sub-image having a resolution of 1080*1080. The first image data are the higher-resolution image data, and the second image data are the lower-resolution image data. In some embodiments where there are no particular requirements on the display effects, the resolution of the first sub-image is equal to the resolution of the second sub-image.

In step S12, interpolation is performed on the first sub-image to determine the interpolated sub-image to be displayed.

In some embodiments, interpolation may be determined based on the first sub-images in two adjacent frames. That is, interpolation is calculated based on the first sub-image and the corresponding sub-image in the image in the immediately preceding frame.

Figure 2A:
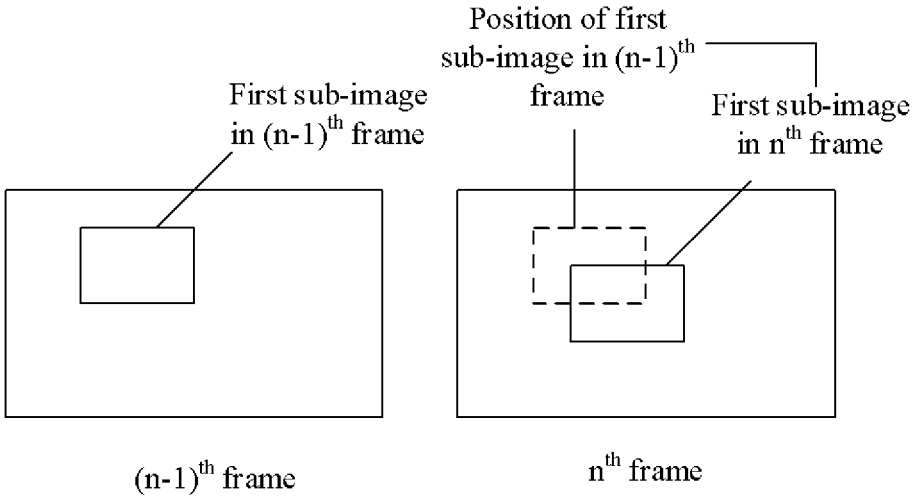
FIGS. 2A and 2B show schematic diagrams illustrating localized interpolation according to embodiments of the present disclosure.

In FIG. 2A, the larger boxes represent the frames. The frame on the left is the immediately preceding frame (the "$(n-1)^{th}$ frame"), and the frame on the right is the current frame (the "$n^{th}$ frame"), with "n" being a positive integer. As shown in FIG. 2A, the solid box in the $(n-1)^{th}$ frame represents the first sub-image in that frame, as determined based on the user's gaze point. The solid box in the $n^{th}$ frame represents the first sub-image in that frame, and is also determined based on the user's gaze point. The dotted box in the $n^{th}$ frame positionally corresponds to the first sub-image in the $(n-1)^{th}$ frame (i.e., the solid box in the $n-1^{th}$ frame).

Interpolation is determined based on the positions of the dotted box in the $n^{th}$ frame and the solid box in the $(n-1)^{th}$ frame. For example, pixel value and motion vector analysis may be performed on the image data for the sub-images in the two frames, and the information is used to determine interpolation. When a difference between positions of the sub-images in the $n^{th}$ and $(n-1)^{th}$ frames is equal to or higher than a predetermined threshold value, the interpolated sub-image is the sub-image in the $(n-1)^{th}$ frame. That is, the pixels in the sub-image in the $(n-1)^{th}$ frame are interpolated and displayed. Conversely, when a difference between positions of the sub-images in the $n^{th}$ and $(n-1)^{th}$ frames is below the predetermined threshold value, the interpolated sub-image is an overlapped portion of the first sub-image in the $n^{th}$ frame and the corresponding sub-image in the $(n-1)^{th}$ frame. The non-overlapping portion of the sub-images is pixel-filled. In some embodiments, the threshold value (i.e., the amount by which the positions of the sub-images in the $n^{th}$ and $(n-1)^{th}$ frames differ with respect to each other) may be in the range of from 5 to 10%. However, it is understood that the threshold value may be adjusted to any appropriate value known to a person of ordinary skill in the art, depending on need and the specific implementation of the display technology.

During interpolation the backlight maintains the same brightness for the full image as in the preceding frame. As such, the interpolated sub-image obtained in accordance with the embodiment illustrated in FIG. 2A is configured to be displayed with the existing backlight brightness, and the resulting display effect is more seamless.

Figure 2B:
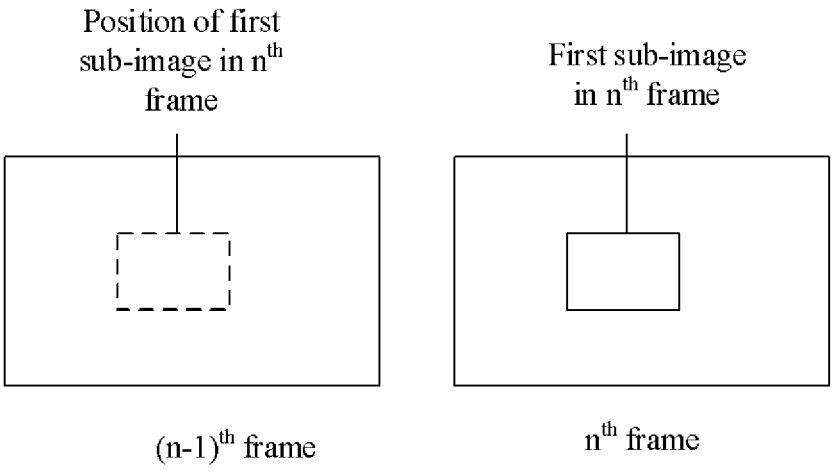

In FIG. 2B, the larger boxes represent the frames. The frame on the left is the immediately preceding frame (the "$(n-1)^{th}$ frame"), and the frame on the right is the current frame (the "$n^{th}$ frame"), with "n" being a positive integer. As shown in FIG. 2B, the solid box in the $n^{th}$ frame represents the first sub-image in that frame, as determined based on the user's gaze point. The dotted box in the $(n-1)^{th}$ frame represents the sub-image that corresponds to the first sub-image in the $n^{th}$ frame. Interpolation is calculated based on the positions of the first sub-image in the $n^{th}$ frame (i.e., the solid box in the $n^{th}$ frame) and the area in the $(n-1)^{th}$ frame that corresponds to the first sub-image in the $n^{th}$ frame (i.e., the dotted box in the $(n-1)^{th}$ frame). FIGS. 2A and 2B differ in that in FIG. 2B, interpolation does not depend on the position of the first sub-image in the preceding frame, and thus makes it possible to simplify the calculations.

In step S13, the interpolated sub-image is displayed.

In some embodiments, the interpolated sub-image is displayed before the image for the current frame is displayed. For example, after the image for display in the $n^{th}$ frame is received, the interpolated sub-image is calculated based on that image, and the interpolated sub-image is displayed before the $n^{th}$ frame is displayed.

In some embodiments, during display, the composite image of the first sub-image and the second sub-image, and the composite image of the interpolated sub-image and the second sub-image are alternately displayed.

For example, at time t=n, a first image composed of the first sub-image and the second sub-image is displayed, and at time t=n+1, a second image composed of the interpolated sub-image and the second sub-image is displayed. The second sub-images in the first image at t=n and in the second image at t=n+1 are the same. At time t=n+2, a new image for display in that frame is acquired, and a third image composed of a first sub-image and a second sub-image is displayed, the first sub-image and the second sub-image in the third image being determined based on the newly acquired image.

Since the interpolated sub-image is determined based on the first sub-image, the dimensions of the interpolated sub-image are the same as the dimensions of the first sub-image. If the second sub-image represents the remainder of the full image outside of the first sub-image, then the full image may be constructed by assembling the second sub-image and the first sub-image, or the second sub-image and the interpolated sub-image. If the second sub-image represents the full image in its entirety, then the full image may be constructed by overlaying the first sub-image or the interpolated sub-image on the positionally corresponding portion of the second sub-image.

Figure 7:
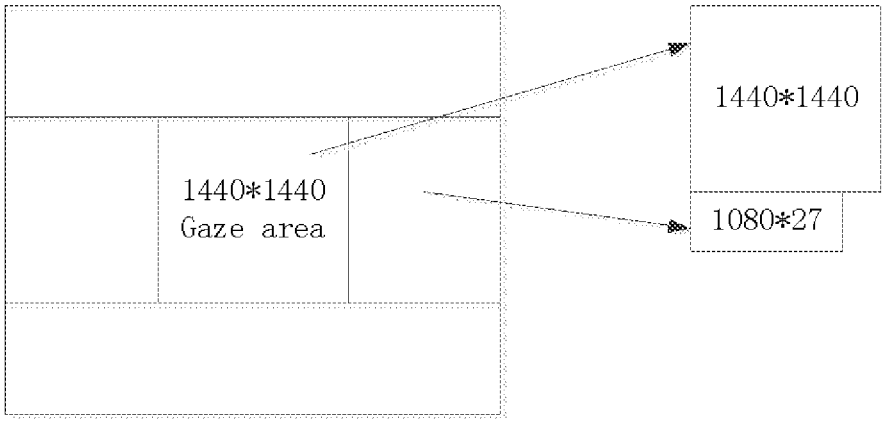
FIG. 7 shows a schematic diagram illustrating the display of an interpolated sub-image according to the present disclosure.

In the localized interpolation according to the present disclosure, the interpolated sub-image may be a blend of higher-resolution and lower-resolution data, and in such a situation, the resolution of the interpolated sub-image may be intermediate of the resolution of the first sub-image (that is, higher resolution) and that of the second sub-image (that is, lower resolution). For example, FIG. 7 shows a schematic diagram illustrating the display of an interpolated sub-image according to the present disclosure. As shown in FIG. 7, the 1440*1440 box defines the area of the first sub-image, and the smaller 1080*27 box indicates the interpolated data. The remainder of the display defines the second sub-image.

The present disclosure obviates the need to interpolate the full image. Instead, localized interpolation according to the present disclosure requires inserting only a portion of the full image. The present disclosure thus allows localized adjustments of refresh rate and display effect, which may in turn improve the smoothness of the overall display.

In some embodiments, the image processing method further comprises, before displaying the image for the current frame, mapping the interpolated sub-image onto the display screen. More particularly, the display coordinates of the interpolated sub-image on the display screen are determined. The coordinates of the pixels to be refreshed to display the interpolated sub-image are mapped.

The display coordinates of each pixel in the first sub-image on the display screen are determined based on the coordinates of the pixels in the first sub-image. The display coordinates of each pixel in the second sub-image on the display screen are similarly determined based on the coordinates of the pixels in the second sub-image. In at least some embodiments, the interpolated sub-image is obtained based on the first sub-image, the display coordinates of the interpolated sub-image are the same as the coordinates of the first sub-image.

As to the first sub-image, the pixels of the display screen may or may not correspond to the pixels in the first sub-image. If there is a one-to-one correspondence between the pixels in the first sub-image and the pixels of the display screen, then the display coordinates of the pixels in the first sub-image on the display screen may be calculated using a simple conversion of the coordinates of the pixels in the first sub-image.

As to the second sub-image, if the resolution of the second sub-image is lower (for example, lower than the resolution of the display screen), then to determine the display coordinates of the pixels in the second sub-image, the second sub-image may first be upscaled by a factor of x, with x being the ratio of the resolution of the display screen to the resolution of the second sub-image. By determining the display coordinates, it becomes possible to map the image data onto the display screen.

In some embodiments, the image processing method comprises, before displaying the interpolated sub-image, determining a backlight brightness value for the display screen to display the interpolated sub-image, based on the image to be displayed in the frame. The image processing method may further comprise adjusting the grayscale value of each pixel of the display screen when displaying the interpolated sub-image in accordance with the determined backlight brightness. In some embodiments where the display screen utilizes a direct backlight, the brightness of the backlight may be reduced using local dimming technology to reduce power consumption. However, in order to maintain the display quality, the gray scale of each pixel may need to be compensated.

Once the backlight brightness value for the full image to be displayed is determined, the interpolated sub-image is displayed in accordance with the backlight brightness value determined for the full image. In so doing, the present disclosure makes it possible to reduce data processing load. The backlight brightness value may be determined based on the gray scale of the image to be displayed. To determine the backlight brightness value, the backlight is partitioned into subunits, and the image data are correspondingly partitioned into subunits according to the backlight partitions and value for each subunit of the image data is calculated. For example, an expected brightness for each subunit of image data is obtained by applying histogram statistics or taking the average or maximum brightness for the image to be displayed, and the expected brightness is then assigned to the backlight subunit corresponding to each image data subunit.

In some embodiments, after the display coordinates for the interpolated sub-image are obtained, the grayscale value at each pixel coordinate on the display screen may be determined based on the corresponding pixels in the first sub-image and sub-images other than the first sub-image. In some embodiments, grayscale value is determined based on the configurations of the backlight and the image to be displayed. Once the first sub-image (or the interpolated sub-image) and the second sub-image are mapped to their actual positions on the display screen, simulated diffusion point spread function (PSF) of the brightness of the backlight subunits is calculated to generate an equivalent backlight brightness value A (0 to 255) for the corresponding pixel. When A=0, the pixel is totally dark. When A=255, the pixel is totally bright. Intermediate values between 0 and 255 correspond to intermediate brightness. A pixel that has not been adjusted for backlight brightness has a backlight value of 255, that is, the pixel is totally bright. Backlight brightness adjustment decreases the brightness of the pixel by an amount equal to A/255, and the grayscale GL of the pixel is increased by an amount equal to GL*(255/A). When A=0, GL=0.

In some embodiments, in step S13, when displaying the interpolated sub-image, image data at the non-interpolated positions remain the same as in the preceding frame. "Non-interpolated positions" refer to positions outside the interpolated sub-image in a lateral or horizontal direction, or positions outside the interpolated sub-image but are located on the same gate lines as the interpolated sub-image.

Interpolation is applied to data for rows of pixels in the higher-resolution area of an image, and as such, only gate lines corresponding to that higher-resolution area need to be activated. The principle under which a display operates is the sequential scanning of gate lines. When a row of gate lines is activated, data is transmitted to the pixels corresponding to each data line. In order to display the data corresponding to the higher-resolution area, the corresponding gate lines need to be sequentially turned on. Thus, the gate lines corresponding to the interpolated sub-image are selectively refreshed, and the image data at the non-interpolated positions are the same image data displayed at the corresponding positions in the preceding frame. The gate lines corresponding to the interpolated sub-image are selectively activated, and image data at non-interpolated positions within the area on the display screen corresponding to the activated gate lines are the same image data displayed at the corresponding positions in the preceding frame. From a user's perspective, information at the non-interpolated positions will appear unchanged.

In other words, when displaying the interpolated sub-image, it is necessary for the display device to selectively activate only the gate lines corresponding to the interpolated sub-image.

Figure 3:
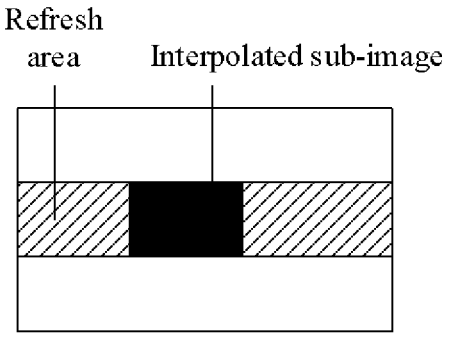
FIG. 3 shows a schematic diagram illustrating the display of an interpolated sub-image according to an embodiment of the present disclosure.

FIG. 3 shows a schematic diagram illustrating the display of an interpolated sub-image according to an embodiment of the present disclosure. As shown in FIG. 3, the solid black box represents the interpolated sub-image. The area encompassing the solid black box and the shaded boxes on the two sides of the solid black box represent the refreshed area, that is, the area defined by the gate lines that are activated. The refreshed area includes a plurality of gate lines and a plurality of signal lines. When the gate lines are activated, the image data transmitted to the solid black box are the image data for the interpolated sub-image, and the image data transmitted to the shaded boxes (i.e., the non-interpolated positions) are the same image data displayed at the corresponding positions in the preceding frame.

The present disclosure comprehensively utilizes gaze point rendering technology and direct backlight technology to enhance display contrast, while using localized interpolation to increase local refresh rate. The present disclosure makes it possible to configure a display device to reduce data load, enhance display contrast, improve display effect, and increase refresh rate, in order to present a display to users that is not only smoother, but also operationally more energy-efficient.

Figure 4:
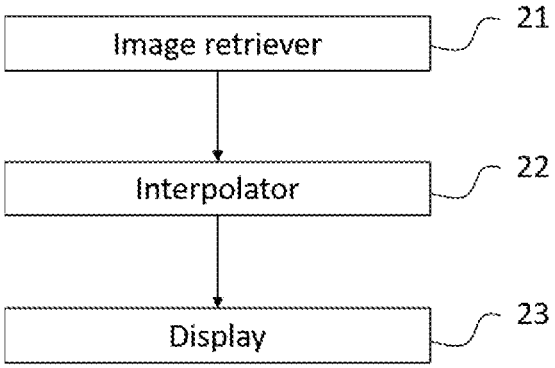
FIG. 4 shows a schematic diagram of a display device according to an embodiment of the present disclosure.

FIG. 4 shows a schematic diagram of a display device according to an embodiment of the present disclosure.

As shown in FIG. 4, the display device comprises an image retriever 21, an interpolator 22, and a display 23. It is understood that the display device may include any additional suitable accessories and/or components known to a person of ordinary skill in the art without departing from the scope and spirit of the present disclosure.

The image retriever 21 is configured to acquire the image to be displayed in a given frame. The image to be displayed comprises the first sub-image and the second sub-image. The resolution of the first sub-image is equal to or higher than the resolution of the second sub-image.

The interpolator 22 is configured to perform interpolation on the first sub-image to determine the interpolated sub-image.

The display 23 is configured to display the interpolated sub-image.

In some embodiments, the image retriever 21 may further be configured to determine a user's gaze point on the display screen, and based on the gaze point and image data, determine the image to be displayed in a given frame.

In some embodiments, the interpolator 22 is configured to determine the interpolated sub-image based on the first sub-image and the corresponding sub-image in the preceding frame. In other embodiments, the interpolator 22 is configured to determine the interpolated sub-image based on the first sub-image in the preceding frame and the sub-image in the current frame that corresponds to the first sub-image in the preceding frame. When a difference between positions of the first sub-image in the $n^{th}$ frame and the corresponding sub-image in the $(n-1)^{th}$ frame is equal to or higher than a predetermined threshold value, the interpolated sub-image is the sub-image in the $(n-1)^{th}$ frame. Conversely, when a difference between positions of the first sub-image in the $n^{th}$ frame and the corresponding sub-image in the $(n-1)^{th}$ frame is below the predetermined threshold value, the interpolated sub-image is an overlapped portion of the first sub-image in the $n^{th}$ frame and the corresponding sub-image in the $(n-1)^{th}$ frame.

In some embodiments, the display 23 is configured to display the interpolated sub-image before displaying the image for the current frame.

In some embodiments, the display 23 is configured to determine the backlight brightness value for the display screen to display the interpolated sub-image, based on the image to be displayed in the frame, and then based on the determined backlight brightness value, determine the gray-scale value for each pixel on the display screen used to display the interpolated sub-image.

In some embodiments, the display 23 is configured to selectively activate the gate lines configured to drive the pixels displaying the interpolated sub-image. Image data at non-interpolated positions in the area on the display screen defined by the selectively activated gate lines are the same image data displayed at the corresponding positions in the preceding frame.

The present disclosure comprehensively utilizes gaze point rendering technology and direct backlight technology to enhance display contrast, while using localized interpolation to increase local refresh rate. The present disclosure makes it possible to configure a display device to reduce data load, enhance display contrast, improve display effect, and increase refresh rate, in order to present a display to users that is not only smoother, but also operationally more energy-efficient.

Figure 5:
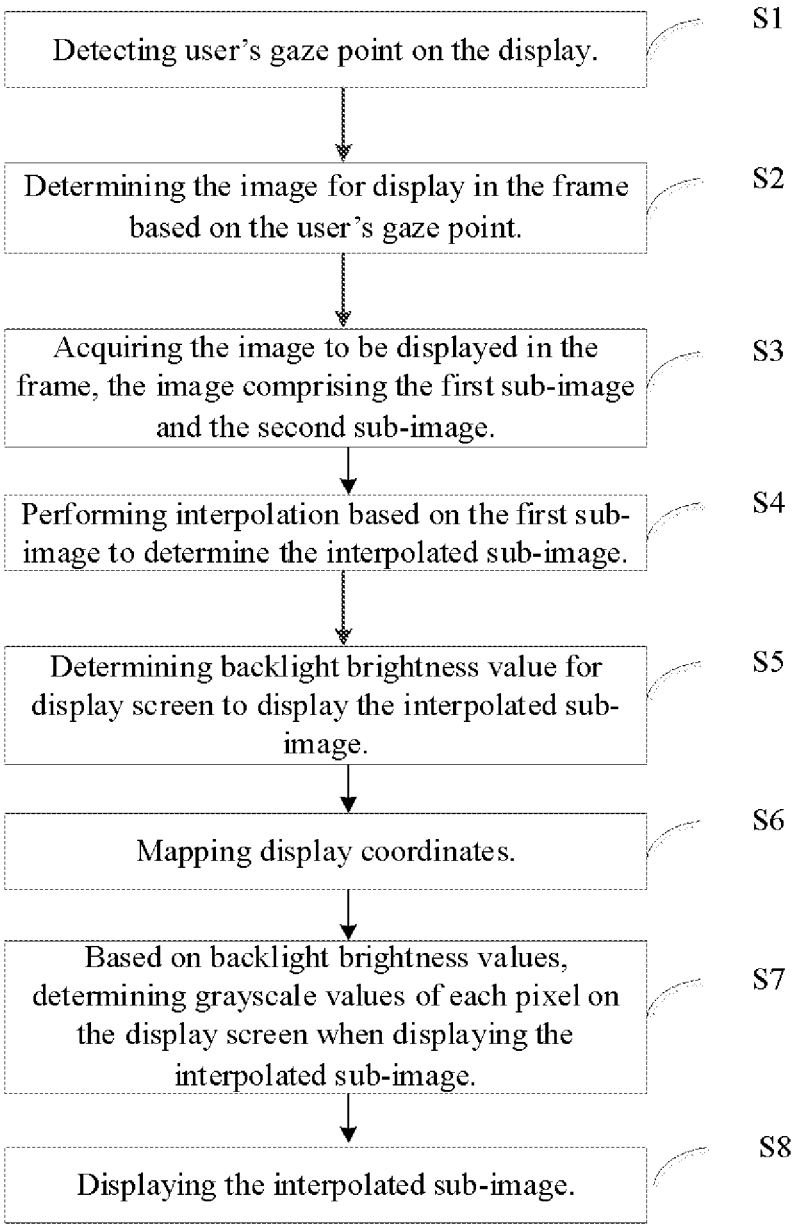
FIG. 5 shows a flow chart of an image display method according to an embodiment of the present disclosure.

FIG. 5 shows a flow chart of an image processing method according to an embodiment of the present disclosure.

As shown in FIG. 5, in step S1, the user's gaze point on the display screen is detected.

For example, in a head-mounted VR display device, the camera may be configured to track the user's eye movements and identify the user's gaze point on the display screen. Based on the user's gaze point and a predetermined radius or perimeter, a gaze area centered on the user's gaze point is identified on the display screen. The gaze area encompasses the first sub-image. The shape of the gaze area is not particularly limited, and may be square, circular, and any other shape known to a person of ordinary skill in the art. In some embodiments, the display screen is a square, and the gaze area is correspondingly configured to be a square. The position of the first sub-image changes with the user's gaze point.

In step S2, the image for display in the frame is determined based on the user's gaze point and image data.

Once the user's gaze point is detected, the first and second sub-images can be identified.

For example, when data conveying a VR scene are rendered, first image data within the gaze area (i.e., the first sub-image) are rendered at a first resolution, and second the image data outside the gaze area (i.e., the second sub-image) are rendered at a second resolution. The first resolution is configured to be equal to or higher than the second resolution. In some embodiments requiring high-definition display, the first resolution is configured to be higher than the second resolution. For instance, as shown in FIG. 6, the first resolution may be configured as 1440*1440, and the second resolution may be configured as 1080*1080. Image data outside the gaze area are rendered, and a full-frame image is obtained.

Rendering may be performed by a graphics processing unit (GPU). When high resolution is required, the GPU is configured to use more pixels to present the content. In other words, the image is more delicate. When a lower resolution suffices, the GPU is configured to use less pixels to present the content. The structure and configurations of the GPU are not particularly limited, and the GPU may be structured and configured in any suitable manner known to a person of ordinary skill in the art depending on need and the specific implementations of the image processing method.

In step S3, the image to be displayed in the frame is acquired. The image comprises the first sub-image and the second sub-image. The resolution of the first sub-image is equal to or higher than the resolution of the second sub-image. In other words, the acquired image is the image identified in step S2.

In step S4, interpolation is performed based on the first sub-image to determine the interpolated sub-image.

After generating the image for display in the frame, the first image data for the first sub-image is stored. When storing the first sub-image, interpolation is calculated based on the first sub-image in the current frame (i.e., the $n^{th}$ frame) and the corresponding sub-image in the preceding image (i.e., the $(n-1)^{th}$ frame). When a difference between positions of the first sub-image in the $n^{th}$ frame and the corresponding sub-image in the $(n-1)^{th}$ frame is equal to or higher than a predetermined threshold value, the interpolated sub-image is the sub-image in the $(n-1)^{th}$ frame. Conversely, when a difference between positions of the first sub-image in the $n^{th}$ frame and the corresponding sub-image in the $(n-1)^{th}$ frame is below the predetermined threshold value, the interpolated sub-image is an overlapped portion of the first sub-image in the $n^{th}$ frame and the corresponding sub-image in the $(n-1)^{th}$ frame.

In some embodiments, the interpolated sub-image is displayed before displaying the image for the current frame. This may increase the frame rate, and improve smoothness of the display. Interpolation may be calculated in any suitable manner known to a person of ordinary skill in the art, and is not particularly limited. For example, interpolation may be calculated using a weighted model.

In step S5, the backlight brightness value is determined for the display screen to display the interpolated sub-image based on the image to be displayed in the frame.

The backlight brightness value may be determined based on the full image to be displayed in the frame, that is, the full-frame image. In some embodiments, the brightness for the backlight is set based on second image data for the second sub-image.

In some embodiments, the display device may be direct-lit. For example, the display device may use a mini-LED array of direct-lit backlight. Each mini LED may be dimensioned to have a length or a width of 100 μm. To increase the display contrast, the brightness of each mini LED may be individually modulated.

To determine the backlight brightness value, the image data is partitioned into subunits according to the partitions of the backlight in the display device. Values for each subunits of the image data are calculated. For example, an expected brightness for each subunit of image data is obtained by applying histogram statistics or taking the average or maximum brightness for the image to be displayed, and the expected brightness is then assigned to the backlight subunit corresponding to each image data subunit.

In some embodiments, the image display method according to the present disclosure may further comprise a step of determining whether to perform interpolation based on a difference between a position of the detected gaze area for the current ($n^{th}$) frame and a position of a gaze area detected for the preceding ($(n-1)^{th}$) frame. If the amount of shift in the position of the detected gaze area is equal to or larger than a predetermined threshold value, interpolation is not performed. If interpolation is not to be performed, then the image display proceeds to mapping first image data for the first sub-image and second image data for the second sub-image onto pixels on a display device. On the other hand, if interpolation is performed, then the image display proceeds to combining the first image data with image data for the corresponding sub-image in the $(n-1)^{th}$ frame to produce image data for the interpolated sub-image. Further, if interpolation is to be performed, localized refreshing of the image data for the first sub-image is performed in the localized area to display the interpolated sub-image, and displaying the second sub-image to have the same content as in the $(n-1)^{th}$ frame.

In step S6, the display coordinates are mapped.

As to the first sub-image, the image data of the first sub-image may be directly mapped to its actual position on the display screen, so long as the appropriate coordinate conversion is performed. For example, the pixels of the display screen may correspond to the pixels in the first sub-image. If there is a one-to-one correspondence between the pixels in the first sub-image and the pixels of the display screen, then the display coordinates of the pixels in the first sub-image on the display screen may be calculated using a simple conversion of the coordinates of the pixels in the first sub-image. In some embodiments, the coordinates of the first sub-image on the display screen is obtained by converting the coordinates of the user's gaze point.

As to the second sub-image, the resolution of the second sub-image may be lower than the resolution of the display screen. Therefore, to determine the display coordinates of the pixels in the second sub-image, the image data of the second sub-image may first be upscaled, for example as shown in FIG. 6. More particularly, the image data may be upscaled by a factor of x, with x being the ratio of the resolution of the display screen to the resolution of the second sub-image. Once the display coordinates, image data of the first and second sub-images may be mapped onto the display screen.

In step S7, based on the backlight brightness values, grayscale values of each pixel on the display screen when displaying the interpolated sub-image are determined.

The grayscale value of each pixel may be calculated based on the correspondence between the input image (for example, the interpolated sub-image to be displayed or the full image to be displayed without interpolation) and the coordinates of the input image on the display, as well as the backlight brightness values of those pixels. The grayscale values may be modulated to compensate for loss in display quality due to local dimming of the backlight.

When calculating the grayscale values of the display screen, the grayscale value of every pixel on the display screen needs to be calculated. Calculation may therefore be performed directly using the full-frame image (for example, the second sub-image). The grayscale value of each pixel in the full-frame image is calculated and transmitted to the display device. As to the interpolated sub-image, the grayscale values of pixels in the interpolated sub-image need to be separately calculated and then transmitted to the display screen.

In step S8, the interpolated sub-image is displayed.

The display device is configured to perform localized refreshing of the current frame to display the interpolated sub-image. The interpolated sub-image is displayed concurrently as the storing of the first sub-image for the next frame. More particularly, the display device is configured to refresh only the gate lines corresponding to the gaze area on the display screen. The interpolated sub-image is displayed in the previously determined gaze area on the display screen. As described above, the gaze area is centered on the user's gaze point and is identified according to the user's gaze point and a predetermined radius or perimeter. The gaze area encompasses the first sub-image. The display device initiates localized refreshing of the gate lines corresponding to the gaze area, including the higher-resolution first sub-image. The display screen displays the interpolated sub-image according to the display coordinates and grayscale values previously determined in the steps described above.

As to the second sub-image, the second sub-image may be displayed on the display screen concurrently as the storing of image data in non-interpolated sub-images that correspond to the activated gate lines. The interpolated sub-image is displayed in the gaze area on the display screen, and the content in the sub-images in the non-gaze areas is not changed. FIG. 7 shows a schematic diagram illustrating the display of an interpolated sub-image according to the present disclosure. As shown in FIG. 7, the 1440*1440 box defines the area of the first sub-image, and the smaller 1080*27 box indicates the interpolated data. The remainder of the display defines the second sub-image. When the interpolated sub-image is displayed, the content constituting the second sub-image is not changed.

In the present disclosure, "storing of image data in non-interpolated sub-images that correspond to the activated gate lines" refers to the storing of pixel values of the non-interpolated sub-images corresponding to the activated gate lines. The stored information may be used later during interpolation to mark the positions on either side of the interpolated sub-image.

As to the interpolated sub-image, the interpolated sub-image is displayed in the gaze area on the display screen. Displaying the interpolated sub-image does not change the image data in the non-interpolated sub-images that correspond to the activated gate lines. From a user's perspective, information at the non-interpolated positions will therefore appear unchanged.

In some embodiments where the display device is a liquid crystal display device, the display screen turns on line by line, so that when displaying the interpolated sub-image, the gate lines above and below the gaze area are not turned on and the image data supplied by those gate lines are unchanged. However, since the gate lines in practice drive pixels for the non-interpolated sub-image display in the same row as the pixels for the interpolated sub-image, those pixels for the non-interpolated sub-image display are turned on concurrently as the pixels for the interpolated sub-image.

In some embodiments, the display device's gate circuit may comprise a capacitor configured to control the timing of the driving of the gate circuit, in order to effect localized refreshing.

The timing of the driving of the gate circuit changes with the user's gaze point in the vertical or longitudinal position. That is, the gate lines that are to be opened change depending on the coordinates of the user's gaze point.

During the first scan, which is a full-screen scan, the capacitor positionally corresponding to the gaze area is charged using a corresponding drive circuit. The capacitance of the capacitor is sufficient to drive the gaze area while skipping the portions of the screen outside the gaze area during the second scan. The capacitor is then discharged to ensure that the third scan can be a full-screen scan.

By controlling localized driving of the gate circuit, the present disclosure makes it possible to effect localized refreshing of the display pixels.

Figure 8:
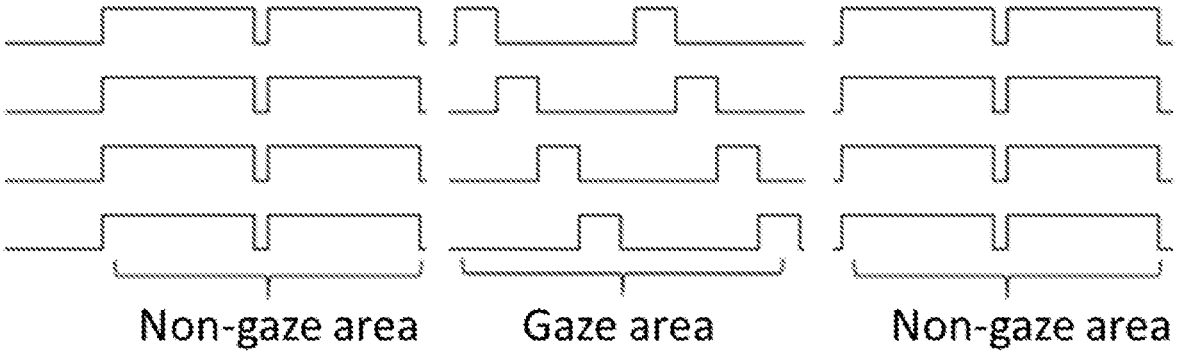
FIG. 8 shows a timing waveform charts illustrating the operation of a display device with interpolation, according to an embodiment of the present disclosure.
Figure 9:
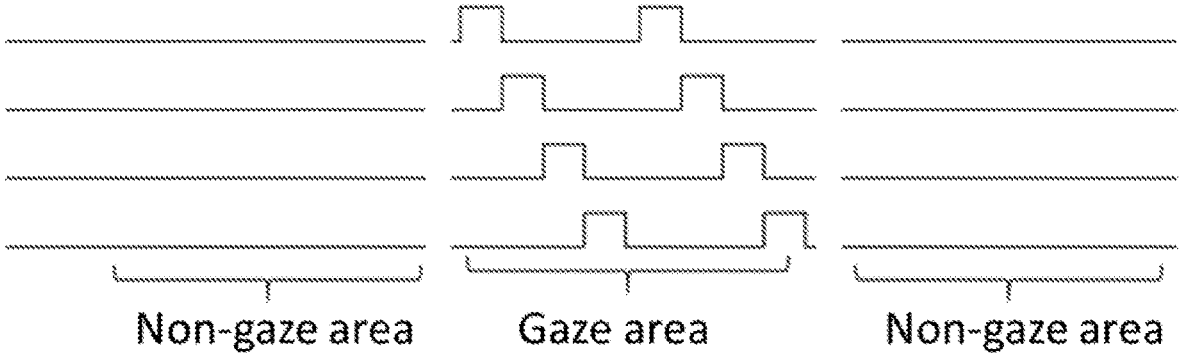
FIG. 9 shows a timing waveform charts illustrating the operation of a display device without interpolation, according to an embodiment of the present disclosure.

FIGS. 8 and 9 show timing waveform charts illustrating the operation for a display device according to an embodiment of the present disclosure. More particularly, FIG. 8 illustrates the operation for a display device without interpolation, and FIG. 9 illustrates the operation for a display device with interpolation. In FIGS. 8 and 9, the sub-images from left to right correspond respectively to the three sub-images illustrated in FIG. 7. That is, the left and right sub-images in FIGS. 8 and 9 correspond to the left and right sub-images in FIG. 7, respectively, and the center sub-image as defined by the gaze area in FIGS. 8 and 9 correspond to the gaze area in FIG. 7.

As an illustrative, non-limiting example, each of the sub-images shown in FIG. 8 may contain four gate lines. The four gate lines in the sub-images in the non-gaze areas are simultaneously or concurrently enabled or activated. On the other hand, the sub-image in the gaze area has a higher resolution than the sub-images in the non-gaze areas, and as such, demands a higher data process load. The gate lines in the gaze area may therefore be enabled or activated in a staggered manner. More particularly, as shown in FIG. 8, only one gate line is activated at a time in the gaze area.

After interpolation, to display the interpolated sub-image in the gaze area, only the gaze area is refreshed. In other words, only the gate lines corresponding to the gaze area are refreshed, and as shown in FIG. 9, the gate lines in the gaze area are refreshed in a staggered manner, that is, one at a time. The sub-images in the non-gaze areas are not interpolated, and are therefore not refreshed. The gate lines corresponding to the non-interpolated sub-images are not refreshed, and as shown in FIG. 9, the gate lines are turned off.

Figure 10:
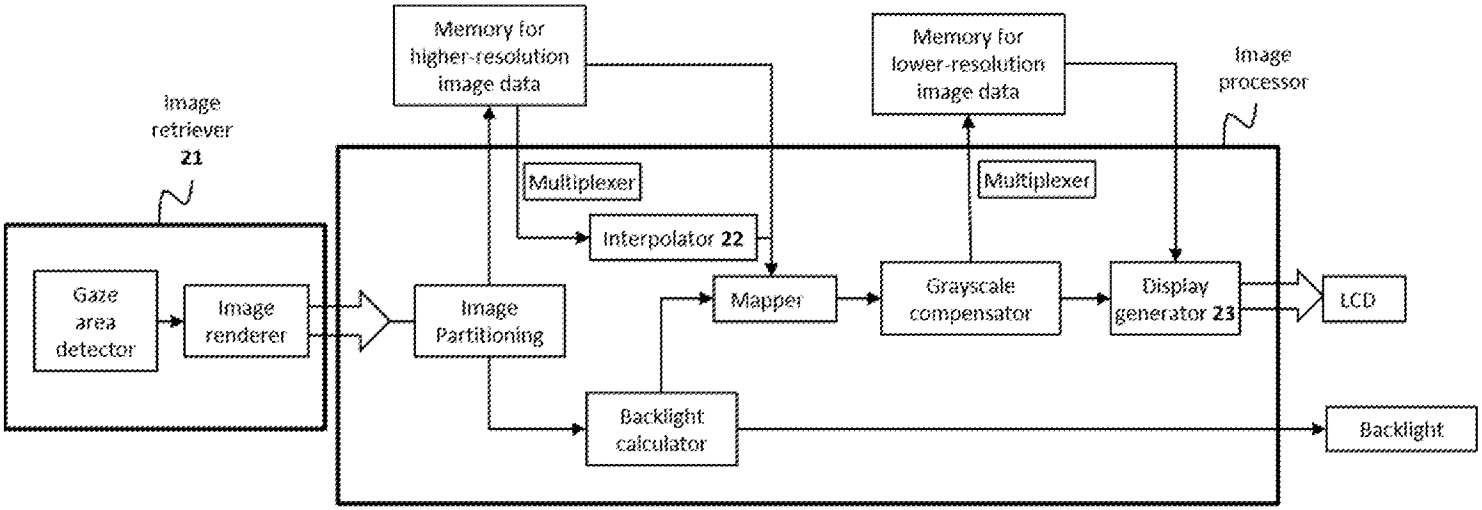
FIG. 10 shows a schematic diagram of a display system according to an embodiment of the present disclosure.

FIG. 10 shows a schematic diagram of a display system according to an embodiment of the present disclosure.

As shown in FIG. 10, the display system comprises an image retriever 21 that comprises a gaze area detector and an image renderer. The display system further comprises an interpolator 22. The display system further comprises a display 23 that comprises a backlight calculator, a mapper, a grayscale compensator, and a display generator. The backlight calculator, the mapper, the grayscale compensator, and the display generator are configured to be the display driving circuit for the display panel (for example, the LCD shown in FIG. 10) and the associated backlight.

The gaze area detector is configured to identify the gaze area on the display screen. In some embodiments, the image display method according to the present disclosure comprises determining whether to perform interpolation based on a difference between a position of the detected gaze area for the $n^{th}$ frame and a position of a gaze area detected for the $(n-1)^{th}$ frame. If the amount of shift in the position of the detected gaze area is equal to or larger than a predetermined threshold value, interpolation is not performed.

The image renderer is configured to render image data, and after the image data have been rendered, the image renderer is configured to partition and process the image data into higher-resolution first image data and lower-resolution second image data. The image renderer is configured to transmit the higher-resolution first image data for storage in a memory unit for higher-resolution image data. Data from this memory unit may be output through a multiplexer and the interpolator, or bypass the interpolator to be output through the mapper, for example, as shown in FIG. 10. The image renderer is configured to transmit the lower-resolution second image data to the backlight calculator of the display 23, wherein the lower-resolution second image data is used to determine and set the backlight brightness values, which are then transmitted to the backlight.

If a given frame does not require interpolation, then the higher-resolution first image data and the lower-resolution second image data for that frame are transmitted to the mapper. The mapper is configured to map the image data onto the display screen based on the display coordinates of the gaze area on the display screen. To map the image data, the mapper is configured to associate pixels on the display screen with the corresponding image data, and to assign display coordinates to the image data. If the frame requires interpolation, then the higher-resolution first image data are combined with the corresponding higher-resolution image data for the preceding frame, and which have already been stored. The combined higher-resolution image data are transmitted to the interpolator 22 to obtain new higher-resolution image data, that is, the interpolating image data.

The grayscale compensator is configured to acquire the display coordinates of the lower-resolution (or higher-resolution) pixels on the display screen, and determine the grayscale values for those pixels. The data may be transmitted, via a multiplexer, for storage in a memory unit for lower-resolution image data. The grayscale of the display screen is determined based on the configurations of the backlight for the display screen and the image data.

The backlight values determined by the backlight calculator are transmitted to the mapper, and the image data are transmitted to the backlight. The mapper is configured to map the higher-resolution first image data and the lower-resolution second image data to their display positions on the display screen. The display positions of the higher-resolution and lower-resolution image data correspond to the partitioned subunits in the backlight. The grayscale compensator is configured to perform simulated diffusion point spread function (PSF) on each of the backlight's partitioned subunits to determine an equivalent backlight value A (0 to 255) for the positionally corresponding pixel. When A=0, the pixel is totally dark. When A=255, the pixel is totally bright. Intermediate values between 0 and 255 correspond to intermediate brightness. A pixel that has not undergone backlight modulation has a backlight value of 255, that is, the pixel is totally bright. Backlight modulation decreases the brightness of the pixel by an amount equal to A/255, and the grayscale GL of the display screen is increased by an amount equal to GL*(255/A).

The display generator is configured to determine whether a frame requires interpolation. If the frame does not require interpolation, the display generator is configured to display the lower-resolution image data on the display screen, and concurrently to store information for non-gaze areas that correspond to the same gate lines as the gaze area. If the frame requires interpolation, the display generator is configured to display the lower-resolution image data that have been stored from the preceding frame in the lower-resolution area, and to perform localized refreshing of the image data in the higher-resolution area with higher-resolution image data obtained from the interpolator and the grayscale compensator according to the timing by which the corresponding gate lines are sequentially activated.

It is understood that the functional units and operations described above can be implemented using any combination of hardware and/or software, including components or modules such as one or more memory devices or circuitry. For example, a programmable gate array or like circuitry can be configured to implement such functional units. In other examples, a microprocessor operating a program in memory can also implement such functional units.

The embodiments of the present disclosure may be implemented in a VR display system. The present disclosure integrates gaze point rendering technology, the direct backlight, and localized interpolation to enhance contrast and to improve refresh rate within the user's gaze area. The present disclosure advantageously reduces the amount of transmitted data, enhances picture quality, and increases refresh rate to produce display effects for the VR display system that are smoother and more energy-efficient.

Figure 11:
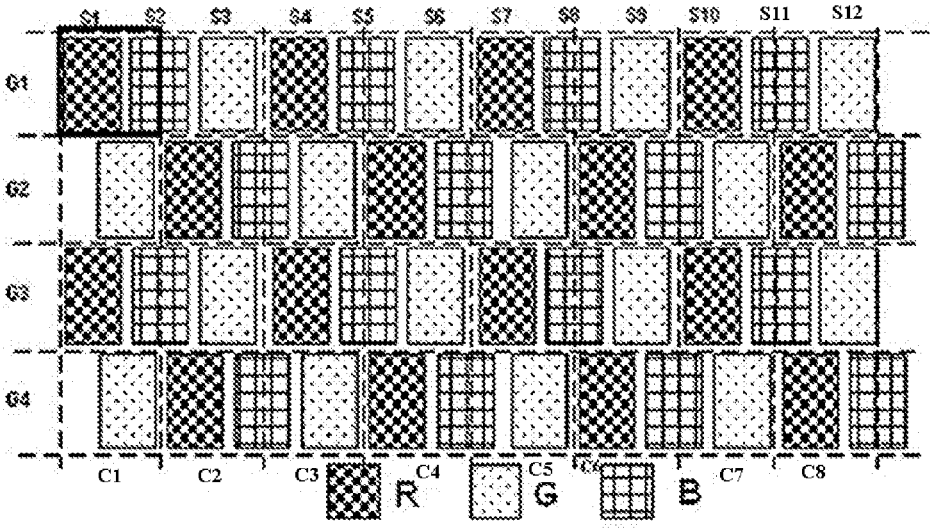
FIG. 11 shows a schematic diagram of a pixel array in related technologies.

The embodiments of the present disclosure may also be implemented in a Bright View III (BV3) display panel. The BV3 technology involves a pixel structure that is designed to address issues with large data process load and data transmission in display panels with high resolution. FIG. 11 shows a schematic diagram of a pixel array according to the BV3 technology. As shown in FIG. 11, the sub-pixel units are arranged in a Δ shape. The pixel array borrows brightness from the pixels above and below to reduce the source by half with only little to no changes to the display quality. In embodiments where the image processing method according to the present disclosure is implemented in a BV3 display system, image data in the gaze area are displayed in accordance with the BV3 pixel array, and images in the non-gaze areas are displayed on the display panel by controlling gate lines that are synchronized to simultaneously turn on and off.

The present disclosure also provides a display device. The display device may comprise a memory, and a processor coupled to the memory. The memory is configured to store a program that, when executed by a computer, performs the image processing method according to the present disclosure. The processor is configured to perform the image processing method as described above.

The present disclosure also provides a non-transitory computer-readable medium storing a program that, when executed by a computer, performs the image processing method according to the present disclosure.

The term "computer-readable medium" may refer to any computer program product, apparatus and/or device (e.g., magnetic discs, optical disks, memory, Programmable Logic Devices (PLDs) used to provide machine instructions and/or data to a programmable processor, including a machine-readable medium that receives machine instructions as a machine-readable signal. The term "machine-readable signal" refers to any signal used to provide machine instructions and/or data to a programmable processor. The computer-readable medium according to the present disclosure includes, but is not limited to, random access memory (RAM), a read-only memory (ROM), a non-volatile random access memory (NVRAM), a programmable read-only memory (PROM), erasable programmable read-only memory (EPROM), electrically erasable PROM (EEPROM), flash memory, magnetic or optical data storage, registers, disk or tape, such as compact disk (CD) or DVD (digital versatile disc) optical storage media and other non-transitory media.

Each of the modules, units, and/or components in the system for image processing according to the present disclosure may be implemented on one or more computer systems and/or computing devices that may implement the various techniques described herein. The computing device may be in the form on a general-purpose computer, a microprocessor, in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

For example, an exemplary computing device may include a processing system, at least one computer-readable media, and at least one I/O interface, which are communicatively coupled to one another. The computing device may further include a system bus or other data and command transfer system that couples the various components to one another. A system bus can include any one or combination of different bus structures, such as a memory bus or memory controller, a peripheral bus, a universal serial bus, and/or a processor or local bus that utilizes any of a variety of bus architectures. A variety of other examples are also contemplated, such as control and data lines.

The processing system is configured to perform one or more operations using hardware, and may therefore include hardware elements that may be configured as processors, functional blocks, and the like. This may include implementation in hardware as an application specific integrated circuit or other logic device formed using one or more semiconductors. Hardware elements are not limited by the materials from which they are formed or the processing mechanisms employed therein. Processors may contain semiconductor and/or transistors (for example, electronic integrated circuits).

Computer programs (also known as programs, applications, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

I/O interfaces may be any device that allows a user to enter commands and information to the computing device, and also allow information to be presented to the user and/or other components or devices. Examples include, but are not limited to, a display device (e.g., a CRT (cathode ray tube) or LCD (liquid crystal display) monitor) for displaying information to the user, a keyboard and a pointing device (e.g., a mouse or a trackball) by which the user can provide input to the computer. Other kinds of accessories and/or devices can be used to provide for interaction with a user as well, including, for example, feedback provided to the user can be any form of sensory feedback (e.g., visual feedback, auditory feedback, or tactile feedback). Input from the user can be received in any form, including acoustic, speech, or tactile input.

Various features, implementations, and techniques are described in the present disclosure in the general context of software, hardware elements, or program modules. Generally, such modules include routines, programs, objects, elements, components, data structures, and so forth, which perform particular tasks or implement particular abstract data types. The terms "module", "functionality", "component" as used herein generally represent software, firmware, hardware, or a combination thereof. The features of the techniques described in the present disclosure are platform-independent, meaning that the techniques may be implemented on a variety of computing platforms having a variety of processors.

References in the present disclosure made to the term "some embodiment," "some embodiments," and "exemplary embodiments," "example," and "specific example," or "some examples" and the like are intended to refer that specific features and structures, materials or characteristics described in connection with the embodiment or example that are included in at least some embodiments or example of the present disclosure. The schematic expression of the terms does not necessarily refer to the same embodiment or example. Moreover, the specific features, structures, materials or characteristics described may be included in any suitable manner in any one or more embodiments or examples. In addition, for a person of ordinary skill in the art, the disclosure relates to the scope of the present disclosure, and the technical scheme is not limited to the specific combination of the technical features, and also should cover other technical schemes which are formed by combining the technical features or the equivalent features of the technical features without departing from the inventive concept. Unless otherwise defined, all the technical and scientific terms used herein have the same meanings as commonly understood by one of ordinary skill in the art to which the present invention belongs. Terms such as "first," "second," and so on, are not intended to indicate any sequence, amount or importance, but distinguish various components. Terms such as "comprises," "comprising," "includes," "including," and so on, are intended to specify that the elements or the objects stated before these terms encompass the elements or the objects and equivalents thereof listed after these terms, but do not preclude the other elements or objects. Phrases such as "connect", "connected", and the like, are not intended to define a physical connection or mechanical connection, but may include an electrical connection, directly or indirectly. Terms such as "on," "under," "right," "left" and the like are only used to indicate relative position relationship, and when the position of the object which is described is changed, the relative position relationship may be changed accordingly.

The principle and the embodiment of the present disclosures are set forth in the specification. The description of the embodiments of the present disclosure is only used to help understand the embodiments of the present disclosure and the core idea thereof. Meanwhile, for a person of ordinary skill in the art, the disclosure relates to the scope of the disclosure, and the technical scheme is not limited to the specific combination of the technical features, and also should covered other technical schemes which are formed by combining the technical features or the equivalent features of the technical features without departing from the inventive concept. For example, technical scheme may be obtained by replacing the features described above as disclosed in this disclosure (but not limited to) with similar features.

What is claimed is:

1. An image display method, comprising:

acquiring an image for display in an $n^{th}$ frame on a display screen, detecting a first sub-image and a second sub-image within the image, a resolution of the first sub-image being higher than a resolution of the second sub-image, comparing the first sub-image in the $n^{th}$ frame with a corresponding sub-image in an $(n-1)^{th}$ frame, and refreshing a localized area of the display screen positionally corresponding to the first sub-image to display an interpolated sub-image in the localized area;

wherein when a difference between positions of the first sub-image in the $n^{th}$ frame and the corresponding sub-image in the $(n-1)^{th}$ frame is equal to or higher than a predetermined threshold value, the interpolated sub-image is the sub-image in the $(n-1)^{th}$ frame, and wherein when a difference between positions of the first sub-image in the $n^{th}$ frame and the corresponding sub-image in the $(n-1)^{th}$ frame is below the predetermined threshold value, the interpolated sub-image is an overlapped portion of the first sub-image in the $n^{th}$ frame and the corresponding sub-image in the $(n-1)^{th}$ frame.

2. The image display method according to claim 1, further comprising:

before acquiring the image for display in the $n^{th}$ frame, detecting a gaze area on the display screen centered on a gaze point of a user, and generating the image for display in the $n^{th}$ frame based on the detected gaze area on the display screen.

3. The image display method according to claim 2, further comprising:

after generating the image for display in the $n^{th}$ frame, storing first image data for the first sub-image, and setting brightness for a backlight based on second image data for the second sub-image.

4. The image display method according to claim 2, further comprising:

determining whether to perform interpolation based on a difference between a position of the detected gaze area for the $n^{th}$ frame and a position of a gaze area detected for the $(n-1)^{th}$ frame.

5. The image display method according to claim 4, further comprising: if interpolation is not to be performed, mapping first image data for the first sub-image and second image data for the second sub-image onto pixels on a display device, and if interpolation is to be performed, combining the first image data with image data for the corresponding sub-image in the $(n-1)^{th}$ frame to produce image data for the interpolated sub-image.

6. The image display method according to claim 5, further comprising:

if interpolation is to be performed, performing localized refreshing of the image data for the first sub-image in the localized area to display the interpolated sub-image, and displaying the second sub-image to have the same content as in the $(n-1)^{th}$ frame.

7. The image display method according to claim 1, wherein the refreshing of the localized area comprises selectively activating gate lines for driving the localized area.

8. The image display method according to claim 1, wherein the interpolated sub-image is dimensioned to be the same as the first sub-image.

9. The image display method according to claim 7, wherein during the refreshing of the localized area, gate lines for driving areas outside of the localized area are not activated.

10. The image display method according to claim 1, further comprising:

before displaying the interpolated sub-image, determining a backlight brightness value for the display screen to display the interpolated sub-image.

11. The image display method according to claim 10, further comprising:

after determining the backlight brightness value and before displaying the interpolated sub-image, mapping the interpolated sub-image to respective pixels of the display screen.

12. The image display method according to claim 11, further comprising:

after mapping the interpolated sub-image and before displaying the interpolated sub-image, determining a grayscale value for each of the mapped pixels in accordance with the determined backlight brightness value.

13. The image display method according to claim 1, further comprising:

before displaying the interpolated sub-image, determining display coordinates of the first sub-image and the second sub-image on the display screen based on respective pixel coordinates in the first and second sub-image.

14. A non-transitory computer-readable medium storing a program that, when executed by a computer, performs the image display method according to claim 1.

15. A display system, comprising:

a non-transitory memory, and a processor coupled to the non-transitory memory, the processor being configured to perform the image display method according to claim 1.

16. A display device, comprising:

an image retriever configured to acquire an image for display in an $n^{th}$ frame on a display screen, and detect a first sub-image and a second sub-image within the image, a resolution of the first sub-image being higher than a resolution of the second sub-image, an interpolator configured to determine an interpolated sub-image by comparing the first sub-image in the $n^{th}$ frame with a corresponding sub-image in an $(n-1)^{th}$ frame, and a display configured to refresh a localized area of the display screen positionally corresponding to the first sub-image to display the interpolated sub-image in the localized area;

wherein when a difference between positions of the first sub-image in the $n^{th}$ frame and the corresponding sub-image in the $(n-1)^{th}$ frame is equal to or higher than a predetermined threshold value, the interpolated sub-image is the sub-image in the $(n-1)^{th}$ frame, and wherein when a difference between positions of the first sub-image in the $n^{th}$ frame and the corresponding sub-image in the $(n-1)^{th}$ frame is below the predetermined threshold value, the interpolated sub-image is an overlapped portion of the first sub-image in the $n^{th}$ frame and the corresponding sub-image in the $(n-1)^{th}$ frame.

17. The display device according to claim 16, wherein the display is further configured to selectively activate gate lines for driving the localized area to display the interpolated sub-image in the localized area.

18. The display device according to claim 16, wherein the display comprises a backlight calculator, a mapper, and a grayscale compensator, and wherein the backlight calculator is configured to, before the interpolated sub-image is displayed, determine a backlight brightness value for the display screen to display the interpolated sub-image.

* * * * *